US007285693B2

(12) United States Patent
Clark

(10) Patent No.: US 7,285,693 B2
(45) Date of Patent: Oct. 23, 2007

(54) PROCESS TO PREPARE A CATALYTICALLY DEWAXED GAS OIL OR GAS OIL BLENDING COMPONENT

(75) Inventor: Richard Hugh Clark, Chester (GB)

(73) Assignee: Shell Oil Company, Houston, TX (US)

( * ) Notice: Subject to any disclaimer, the term of this patent is extended or adjusted under 35 U.S.C. 154(b) by 289 days.

(21) Appl. No.: 10/505,670

(22) PCT Filed: Feb. 25, 2003

(86) PCT No.: PCT/EP03/01911

§ 371 (c)(1),
(2), (4) Date: Aug. 24, 2004

(87) PCT Pub. No.: WO03/070857

PCT Pub. Date: Aug. 28, 2003

(65) Prior Publication Data

US 2005/0090700 A1 Apr. 28, 2005

(30) Foreign Application Priority Data

Feb. 25, 2002 (EP) ..... 02251279
Aug. 22, 2002 (EP) ..... 02078476

(51) Int. Cl.
*C10L 1/00* (2006.01)
*C10G 65/12* (2006.01)

(52) U.S. Cl. ..... 585/1; 208/14; 208/58; 208/59; 208/950

(58) Field of Classification Search ..... 208/14, 208/58, 59, 950; 585/1
See application file for complete search history.

(56) References Cited

U.S. PATENT DOCUMENTS

| | | | | |
|---|---|---|---|---|
| 4,208,190 | A | 6/1980 | Malec | 44/53 |
| 4,419,220 | A | 12/1983 | LaPierre et al. | 208/111 |
| 4,574,043 | A | 3/1986 | Chester et al. | 208/59 |
| 4,851,109 | A * | 7/1989 | Chen et al. | 208/58 |
| 4,859,311 | A | 8/1989 | Miller | 208/89 |
| 4,943,672 | A | 7/1990 | Hamner et al. | 585/737 |
| 4,983,273 | A | 1/1991 | Kennedy et al. | 208/89 |
| 5,053,373 | A | 10/1991 | Zones | 502/64 |

(Continued)

FOREIGN PATENT DOCUMENTS

AU 5785862 7/1998

(Continued)

OTHER PUBLICATIONS

"Conversion of Natural Gas to Transportation Fuels vis the Shell Middle Distillate Synthesis Process (SMDS)". S. T. Sie et al. Catalysis Today. 8 (1991). pp. 371-394.

(Continued)

*Primary Examiner*—Glenn Caldarola
*Assistant Examiner*—Prem C. Singh

(57) ABSTRACT

A process to prepare a catalytically dewaxed gas oil or gas oil blending component by performing the following steps:
(a) hydrocracking/hydroisomerizing a Fischer-Tropsch product;
(b) separating the product of step (a) into at least one or more fuel fractions and a gas oil precursor fraction;
(c) catalytically dewaxing the gas oil precursor fraction obtained in step (b); and,
(d) isolating the catalytically dewaxed gas oil or gas oil blending component from the product of step (c) by means of distillation.

7 Claims, 1 Drawing Sheet

U.S. PATENT DOCUMENTS

| | | | | |
|---|---|---|---|---|
| 5,059,299 | A | 10/1991 | Cody et al. | 208/27 |
| 5,157,191 | A | 10/1992 | Bowes et al. | 585/533 |
| 5,252,527 | A | 10/1993 | Zones | 502/64 |
| 5,689,031 | A | 11/1997 | Berlowitz et al. | 585/734 |
| 6,165,949 | A | 12/2000 | Berlowitz et al. | 508/363 |
| 6,589,415 | B2 * | 7/2003 | Smith et al. | 208/59 |
| 2001/0034308 | A1 | 10/2001 | Krull et al. | 508/500 |

FOREIGN PATENT DOCUMENTS

| | | |
|---|---|---|
| AU | 698392 | 10/1998 |
| EP | 0280476 | 8/1988 |
| EP | 0321305 | 6/1989 |
| EP | 0532118 | 3/1993 |
| EP | 0668342 | 8/1995 |
| EP | 0776959 | 6/1997 |
| EP | 1081210 | 8/2000 |
| EP | 01402181.0 | 5/2002 |
| WO | 94/10263 | 5/1994 |
| WO | WO199603359 | 2/1996 |
| WO | 96/41849 | 12/1996 |
| WO | WO199641849 | 12/1996 |
| WO | 97/14768 | 4/1997 |
| WO | WO199714768 | 4/1997 |
| WO | 97/18278 | 5/1997 |
| WO | WO 199721788 | 6/1997 |
| WO | 97/23584 | 7/1997 |
| WO | WO199723584 | 7/1997 |
| WO | 98/02503 | 1/1998 |
| WO | 99/20720 | 4/1999 |
| WO | 99/34917 | 7/1999 |
| WO | 00/141/84 | 3/2000 |
| WO | 00/11116 | 3/2000 |
| WO | 00/14179 | 3/2000 |
| WO | 00/14184 | 3/2000 |
| WO | WO200011116 | 3/2000 |
| WO | WO200014179 | 3/2000 |
| WO | WO200014184 | 3/2000 |
| WO | 00/29511 | 5/2000 |
| WO | WO2000078801 | 12/2000 |
| WO | 01/32809 | 5/2001 |
| WO | WO2002064710 | 8/2002 |
| WO | WO2002064711 | 8/2002 |
| WO | WO2002070627 | 9/2002 |
| WO | WO2002070630 | 9/2002 |

OTHER PUBLICATIONS

Peter J.A. Tjim et al, The Markets for Shell Middle Distillate Synthesis Products. Alternate Energy '95. Vancouver Canada. May 2-4, 1995.

Shell MDS (Malaysia) "Manufacturing Clean Products From Natural Gas", May 1995.

ASTM D86, 2006.

ASTM D1160, 2006.

ASTM D2887, 2006.

"Gas Chromatography", a specific extract from the website http://www.schu.ac.uk., providing a description of the gas chromatography technique, Aug. 15, 2006.

"Introduction to Organic Laboratory Techniques", D. L. Pavia et al. 1976, pp. 614-625.

Letter from the Patentee to the EPO dated Jun. 14, 2004 in European Pat. Appl. No. 02716826.9.

Specific extract from the website http://www.deh.gov.au, providing a summary of the development of the European Union fuel standards through the years 1993 and 2000 (so-called "Euro 2" and "Euro 3" respectively) and beyond, for petrol (gasoline) and diesel fuel.

EN 590 1999 Automotive Fuels - Diesel - Requirements and Test Methods, pp. 4-6.

EPC Opposition 2007 - Feb. 2 - Chevron U.S.A. - Publication No. 1487942.

* cited by examiner

PROCESS TO PREPARE A CATALYTICALLY DEWAXED GAS OIL OR GAS OIL BLENDING COMPONENT

FIELD OF THE INVENTION

The invention is related to a process to prepare a catalytically dewaxed gas oil or gas oil blending component.

BACKGROUND OF THE INVENTION

Examples of Fischer-Tropsch synthesis processes steps to prepare said Fischer-Tropsch product and hydroisomerization steps (a) are known from the so-called commercial Sasol process, the commercial Shell Middle Distillate Process or the non-commercial Exxon process. These and other processes are for example described in more detail in EP-A-776959, EP-A-668342, U.S. Pat. No. 4,943,672, U.S. Pat. No. 5,059,299, WO-A-9934917, AU-A-698392 and WO-A-9920720.

SUMMARY OF THE INVENTION

The invention is directed to prepare a catalytically dewaxed gas oil or gas oil blending component by a) hydrocracking/hydroisomerizing a Fischer-Tropsch product,
(b) separating the product of step (a) into at least one or more fuel fractions and a gas oil precursor fraction;
(c) catalytically dewaxing the gas oil precursor fraction obtained in step (b);
(d) isolating the catalytically dewaxed gas oil or gas oil blending component from the product of step (c) by means of distillation; and,
(e) recycling the fraction boiling about the T90 wt % boiling point of between 400 and 500° C. obtained in step (b) to step (a).

BRIEF DESCRIPTION OF THE DRAWING

The FIGURE illustrates a process line up wherein a gas oil blend as described above is obtained.

DETAILED DESCRIPTION OF THE INVENTION

Figure 1:
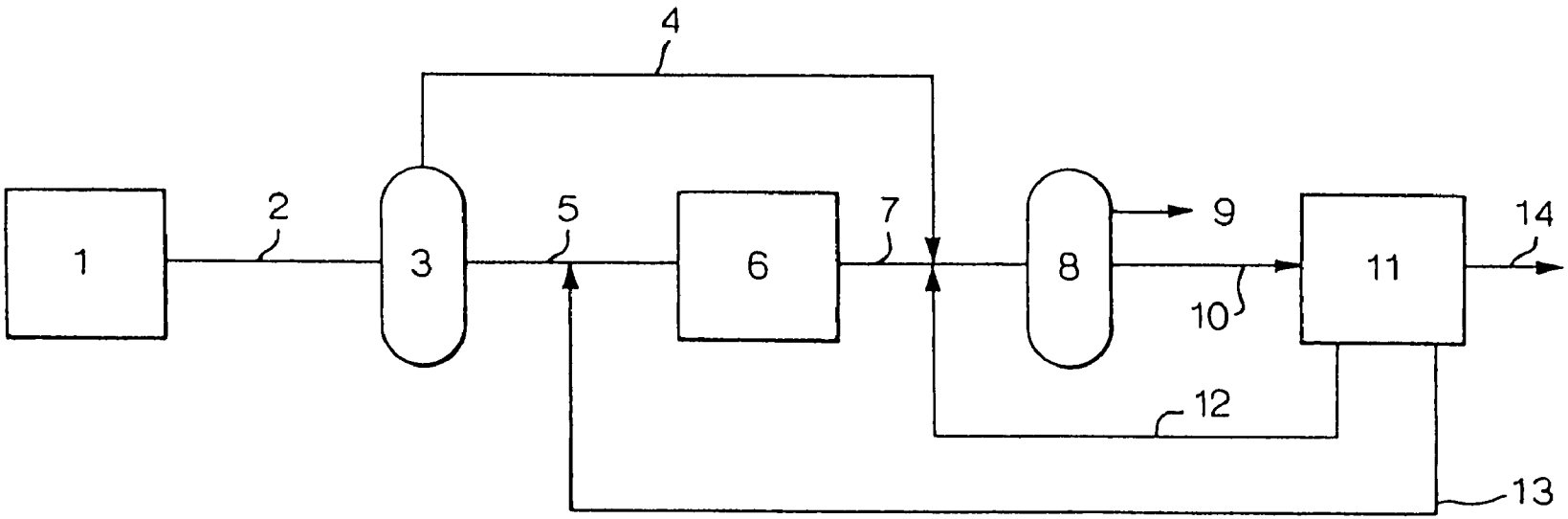

The above process is found advantageous because it yields a gas oil (blending component) in step (d) having excellent cold flow properties like the cloud point and cold filter plugging point. Furthermore, a gas oil (blending component) with excellent lubricity properties is obtained. Finally the yield on feed to step (a) of all gas oil fractions as recovered in step (b) and in step (d) is high.

The Fischer-Tropsch product used in step (a) will contain no or very little sulfur and nitrogen containing compounds. This is typical for a product derived from a Fischer-Tropsch reaction, which uses synthesis gas containing almost no such impurities. Sulfur and nitrogen levels will generally be below their respective detection limits, which are 1 ppm and 5 ppm respectively. It is expected that these values are close to zero. The Fischer-Tropsch product may optionally be subjected to a mild hydrotreating step in order to remove any oxygenates and saturate any olefinic compounds present in the reaction product of the Fischer-Tropsch reaction. Such a hydrotreatment is described in EP-B-668342 which is hereby incorporated by reference. The mildness of the hydrotreating step is preferably expressed in that the degree of conversion in this step is less than 20 wt % and more preferably less than 10 wt %. The conversion is here defined as the weight percentage of the feed boiling above 370° C., which reacts to a fraction boiling below 370° C.

Preferably, any compounds having 4 or less carbon atoms and any compounds having a boiling point in that range are separated from a Fischer-Tropsch synthesis product before being used in step (a). The Fischer-Tropsch product as described in detail above is a Fischer-Tropsch product, which has not been subjected to any hydroconversion step apart from the, above referenced, optional mild hydrotreating step. The content of non-branched compounds in the Fischer-Tropsch product will therefore be above 80 wt %. In addition to the Fischer-Tropsch product, other fractions also may be processed in step (a). Possible other fractions may suitably be a higher boiling fraction obtained in step (b) or part of said fraction and/or one or more of the fractions boiling above the gas oil range as obtained in step (c).

Preferably, the Fischer-Tropsch product used in step (a) has at least 30 wt %, preferably at least 50 wt %, and more preferably at least 55 wt % of compounds having at least 30 carbon atoms. Furthermore, the weight ratio of compounds having at least 60 or more carbon atoms and compounds having at least 30 carbon atoms of the Fischer-Tropsch product is at least 0.2, preferably at least 0.4 and more preferably at least 0.55. Preferably the Fischer-Tropsch product comprises a $C_{20}^{+}$ fraction having an ASF-alpha value (Anderson-Schulz-Flory chain growth factor) of at least 0.925, preferably at least 0.935, more preferably at least 0.945, even more preferably at least 0.955. The initial boiling point of the Fischer-Tropsch product may be as high as 400° C. Preferably the initial boiling point is below 200° C.

When the above Fischer-Tropsch product is used in step (a) an even higher yield to gas oil in step (a), and a high yield in gas oil precursor fraction may be obtained in step (a). Such a feed to step (a) may be prepared by any process, which yields a relatively heavy Fischer-Tropsch product. Examples of suitable Fischer-Tropsch processes to prepare the above feed are described in the earlier referred to WO-A-9934917 and AU-A-698392 which are hereby incorporated by reference.

The hydrocracking/hydroisomerization reaction of step (a) is preferably performed in the presence of hydrogen and a catalyst, which catalyst may be chosen from those known to one skilled in the art as being suitable for this reaction. Catalysts for use in step (a) typically comprise an acidic functionality and a hydrogenation/dehydrogenation functionality. Preferred acidic functionalities are refractory metal oxide carriers. Suitable carrier materials include silica, alumina, silica-alumina, zirconia, titania and mixtures thereof. Preferred carrier materials for inclusion in the catalyst for use in the process of this invention are silica, alumina and silica-alumina. A particularly preferred catalyst comprises platinum supported on a silica-alumina carrier. If desired, applying a halogen moiety, in particular fluorine, or a phosphorus moiety to the carrier, may enhance the acidity of the catalyst carrier. Examples of suitable hydrocracking/hydroisomerization processes and suitable catalysts are described in WO-A-0014179, EP-A-532118, EP-A-666894 and the earlier referred to EP-A-776959 all of which are hereby incorporated by referenced.

Preferred hydrogenation/dehydrogenation functionalities are Group VIII noble metals palladium and more preferably platinum and non-noble metals, for example iron, nickel and cobalt which non-noble metals may or may not be combined with a Group IVB metal, for example W or Mo, oxide promoters. The catalyst may comprise the hydrogenation/dehydrogenation noble metal active component in an amount of from 0.005 to 5 parts by weight, preferably from 0.02 to 2 parts by weight, per 100 parts by weight of carrier material. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder may be non-acidic. Examples are clays and other binders known to one skilled in the art.

In step (a) the feed is contacted with hydrogen in the presence of the catalyst at elevated temperature and pressure. The temperatures typically will be in the range of from 175° C. o 380° C., preferably higher than 250° C. and more preferably from 300° C. to 370° C. The pressure will typically be in the range of from 10 bar to 250 bar and preferably between 20 bar and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in step (a) as defined as the weight percentage of the feed boiling above 370° C. which reacts per pass to a fraction boiling below 370° C., is at least 20 wt %, preferably at least 25 wt %, but preferably not more than 80 wt %, more preferably not more than 70 wt %. The feed as used above in the definition is the total hydrocarbon feed fed to step (a), thus also including any optional recycles as described above.

In step (b) the product of step (a) is preferably separated into one or more fuel fractions, and a gas oil precursor fraction having preferably a T0 wt % boiling point of between 200° C. and 450° C. The T90 wt % boiling point of the gas oil precursor fraction is preferably between 300° C. and preferably between 400° C. and 550° C. It may thus be necessary to also separate a higher boiling fraction from the gas oil precursor fraction in order to meet these T90 wt % boiling points if the product of step (a) contains higher boiling compounds. By performing step (c) on the preferred narrow boiling gas oil precursor fraction obtained in step (b) a gas oil fraction can be obtained having the desired cold flow properties. The separation is preferably performed by means of a first distillation at about atmospheric conditions, preferably at a pressure of between 1.2-2 bara, wherein the fuel product, such as naphtha, kerosene and gas oil fractions, are separated from the higher boiling fraction of the product of step (a). The gas oil fraction obtained directly in step (a) will be referred to as the hydrocracked gas oil fraction. The higher boiling fraction, of which suitably at least 95 wt % boils above 370° C., is subsequently further separated in a vacuum distillation step wherein a vacuum gas oil fraction, the gas oil precursor fraction and the higher boiling fraction are obtained. The vacuum distillation is suitably performed at a pressure of between 0.001 and 0.05 bara.

The vacuum distillation of step (b) is preferably operated such that the desired gas oil precursor fraction is obtained boiling in the specified range. Preferably the kinematic viscosity at 100° C. of the gas oil precursor fraction is between 3 and 10 cSt.

Catalytic dewaxing step (c) will be performed in the presence of hydrogen and a suitable dewaxing catalyst at catalytic dewaxing conditions. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point and cloud point of the gas oil precursor fraction under catalytic dewaxing conditions. Preferably, the intermediate pore size zeolites have a pore diameter of between 0.35 and 0.8 nm. Suitable intermediate pore size zeolites are mordenite, ZSM-5, ZSM-12, ZSM-22, ZSM-23, SSZ-32, ZSM-35 and ZSM-48. Another preferred group of molecular sieves are the silica-alunilnaphosphate (SAPO) materials, for example SAPO-31, SAPO-41 and SAPO-11 of which SAPO-11 is most preferred as for example described in U.S. Pat. No. 4,859,311 which is hereby incorporated by reference. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Pt/mordenite, Pt/ZSM-35, Ni/ZSM-5, Pt/ZSM-23, Pd/ZSM-23, Pt/ZSM-12, Pt/ZSM-48 and Pt/SAPO-11. Further details and examples of suitable molecular sieves and dewaxing conditions are for example described in WO-A-9718278, U.S. Pat. No. 4,343,692, U.S. Pat. No. 5,053,373, WO-A-0014184, U.S. Pat. No. 5,252,527 and U.S. Pat. No. 4,574,043 all of which are hereby incorporated by reference.

The dewaxing catalyst suitably also comprises a binder. The binder may be a synthetic or naturally occurring (inorganic) substance, for example clay, silica and/or metal oxides. Natural occurring clays are, for example, of the montmorillonite and kaolin families. The binder is preferably a porous binder material, for example a refractory oxide of which examples are: alumina, silica-alumina, silica-magnesia, silica-zirconia, silica-thoria silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material, which is essentially free of alumina, is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is by contacting an extrudate of the binder and the zeolite with an aqueous solution of a fluorosilicate salt as described in for example U.S. Pat. No. 5,157,191 or WO-A-0029511 which are hereby incorporated by reference. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22, as for example described in WO-A-0029511 and EP-B-832171 which are hereby incorporated by reference.

Catalytic dewaxing conditions are known in the art and typically involve operating temperatures in the range of from 200° C. to 500° C., suitably from 250° C. to 400° C., hydrogen pressures in the range of from 10 bar to 200 bar, preferably from 40 bar to 70 bar, weight hourly space velocities (WHSV) in the range of from 0.1 to 10 kg of oil per litre of catalyst per hour (kg/l/hr), suitably from 0.2 to 5 kg/l/hr, more suitably from 0.5 to 3 kg/l/hr and hydrogen to oil ratios in the range of from 100 to 2,000 liters of hydrogen per liter of oil.

In step (d) the catalytically dewaxed gas oil fraction is isolated from the product of step (c) by means of distillation. Preferably a vacuum distillation is used, such that the fraction boiling above the gas oil range may also be separated into useful products.

Applicants have found that the gas oil (blending component) as obtained in step (d) may have superior lubricity quality, giving a value of below 460 microns (Wear Scar) or even below 400 microns, as determined by CEC-F-06-A-96 (HFRR test). This is advantageous because this would imply that no lubricity additive is required for this gas oil to meet, for example, the current European Union requirements for lubricity. Or, that in a blend containing the above gas oil blending component less of such an additive is needed.

The gas oil obtained in step (d) can be directly used as a gas oil product or may be used as blending component together with other gas oil blending components. The other blending components may suitably be the gas oil fraction(s) obtained in step (b) of the above process. These gas oil fractions are suitably obtained in the atmospheric distillation of step (b) and in the vacuum distillation of step (b). The cloud point as determined by International Standard ISO 3015 of the gas oil (blending component) as obtained in step (d) is preferably below −40° C. and more preferably below −50° C. The cold filter plugging point (CFFP) as determined by European Standard EN 116 of the gas oil (blending component) as obtained in step (d) is preferably below −30° C. and more preferably below −40° C.

In a preferred embodiment, prior to performing step (b) the, preferably entire, effluent of step (a) is subjected to a catalytic dewaxing step under the dewaxing process conditions and in the presence of the catalyst as described for step (c). In this manner, the cold flow properties of the gas oil fractions obtained in step (b) may also be improved resulting in a blend which is even more suited as a winter gas oil fuel. This dewaxing step may be performed in the same reactor as wherein step (a) is performed. A stacked bed reactor comprising the hydro-cracking/hydroisomerization catalyst on top of the dewaxing catalyst would be a practical and preferred embodiment of how such a reactor would look.

Also, gas oil blending components as obtained from a raw gas field condensate distillate, a mildly hydrotreated gas field condensate distillate or a crude petroleum source, for example, straight run gas oil, cat cracked gas oil and hydrocracked gas oil, may be combined with the dewaxed gas oil as for example described in WO-A-0011116 which is hereby incorporated by reference. If the gas oil as obtained in step (d) is used together with such crude petroleum source or condensate source gas oil fractions the weight percentage of the total of Fischer-Tropsch derived gas oil fractions in such a blend is suitably between 10 and 40 wt % and preferably between 10 and 25 wt %.

Another suitable Fischer-Tropsch based gas oil fraction, which may be blended together with the cat-dewaxed gas oil, is the gas oil fraction obtained from the Fischer-Tropsch product or fraction thereof, which product or fraction thereof has not been subjected to a hydroconversion step. This gas oil fraction will comprise a substantial amount of primary $C_{12}$ to $C_{24}$ alcohols, which alcohols are formed during the Fischer-Tropsch synthesis. Such a gas oil blending component is for example described in WO-A-9714768 which is hereby incorporated by reference. Alcohol compounds may also be formed on purpose by oxidizing the paraffinic gas oil fraction with hydrogen peroxide as for example described in WO-A-0132809 which is hereby incorporated by reference. Gas oil fractions which are recovered from hydroconversion processes, such as the hydrocracking step (a) or the cited mild hydrotreatment will generally comprise no or very low amounts of such alcohols. Thus, by blending such non-hydroconverted gas oil fraction with the cat-dewaxed gas oil, as obtained from the process of the present invention, the (water-free) oxygen content will increase. Preferably the oxygen content in the fraction of Fischer-Tropsch derived gas oil components in such a resulting gas oil blend will comprise between 0.001 to 15 wt % oxygen on a water-free basis, preferably at least 0.3 wt %, more preferably 0.5 to 15 wt % particularly 1 to 10 wt %. An oxygen content of 1 to 4 wt % is preferred and 2 to 3 wt % is most preferred.

The dewaxed gas oil as obtained in step (d) is preferably blended with the gas oil fraction(s) obtained in step (b) of the above process. A blend having improved cold flow properties is thus obtained in a high yield. Blending can be achieved in a tanker park, direct in-line blending of the effluents of steps (b) and (d) or by recycling the dewaxed gas oil as obtained in step (d) to step (b). In the latter preferred option the dewaxed gas oil is suitably fed to the atmospheric distillation of step (b). Any alcohol containing gas oil fractions or sources comprising such a fraction may also be advantageously fed to said atmospheric distillation step of step (b).

The invention is also directed to a blend as described above and, more particularly, a blend comprising the catalytically dewaxed gas oil as obtainable by the above process, a gas oil blending fraction as obtainable in step (b) of the above process and one or more additives. Suitably a blending component is present which is obtained from the Fischer-Tropsch product comprising a substantial amount of $C_{12}$-$C_{24}$ primary alcohols as described above.

The FIGURE illustrates a process line-up wherein a gas oil blend as described above is obtained. In Fischer-Tropsch process reactor (1) a Fischer-Tropsch product (2) is obtained. This product is separated in distillation column (3) into a fraction boiling substantially below 370° C. (4) and a fraction (5) boiling substantially above 370° C., having an initial boiling point of between 340 and 400° C. The heavy fraction (5) is fed as the Fischer-Tropsch product to the hydrocracking/hydroisomerization reactor (6) wherein part of the components boiling above 370° C. are converted to products boiling below 370° C. The effluent (7) of reactor (6) is combined with the light fraction (4) containing also $C_{12}$-$C_{24}$ primary alcohols. This combined stream is distilled in distillation column (8) to recover a blended gas oil product (9) and various other middle distillate fuel products (not shown) such as kerosene and naphtha. In distillation column (8) also a gas oil-precursor fraction (10) is recovered and fed to a catalytic dewaxing reactor (11). From the effluent of reactor (11) the catalytically dewaxed gas oil (12) is isolated (separation column not shown), which gas oil (12) is combined with streams (4) and (7) to be fed to distillation column (8). A heavy fraction (13) boiling substantially above 370° C. is recycled to reactor (6). Optionally valuable fraction(s) (14) are recovered as products. It is obvious that streams (4, 7 and 12) need not necessarily be combined before being fed to distillation column (8) but may also be fed separately to column (8) or blended directly into the resulting gas oil blend (9).

The individual Fischer-Tropsch derived gas oil fractions and their mixtures suitably have a distillation curve which will for its majority be within the typical gas oil range:

between about 150 and 370° C., a T90 wt % of between 340-400° C., a density of between about 0.76 and 0.79 g/cm$^3$ at 15° C., a cetane number greater than 72.7, suitably between about 74 and 82, a sulphur content of less than 5 ppmw, a viscosity between about 2.5 and 4.0 centistokes at 40° C. and an aromatics content of no greater than 1 wt %.

A gas oil blend may, next to these Fischer-Tropsch derived gas oil blending components, also comprise one or more of the petroleum crude derived gas oil fraction or gas condensate gas oil fractions as described above. The type and amount of the crude petroleum derived gas oil components will depend on the application and local environmental regulations.

It has been possible to blend the various low sulphur-Fischer-Tropsch and high sulphur-crude petroleum derived gas oil components to fuel compositions having sulphur content of at most 2000 ppmw (parts per million by weight) sulphur, preferably no more than 500 ppmw, most preferably no more than 50 or even 10 ppmw. The density of such a blend is typically less than 0.86 g/cm$^3$ at 15° C., and preferably less than 0.845 g/cm$^3$ at 15° C. The lower density of such a blend as compared to conventional gas oil blends results from the relatively low density of the Fischer-Tropsch derived gas oils. The above fuel composition is suited as fuel in an indirect injection diesel engine or a direct injection diesel engine, for example of the rotary pump, in-line pump, unit pump, electronic unit injector or common rail type.

The fuel composition itself may be an additized (additive-containing) oil or an unadditized (additive-free) oil. If the fuel oil is an additised oil, it will contain minor amounts of one or more additives, e.g. one or more additives selected from detergent additives, for example those obtained from Infineum (e.g., F7661 and F7685) and Octel (e.g., OMA 4130D); lubricity enhancers, for example EC 832 and PARADYNE 655 (ex Infineum), HITEC E580 (ex Ethyl Corporation), VELTRON 6010 (ex lnfmeum) (PARADYNE, HITEC and VELTRON are trademarks) and amide-based additives such as those available from the Lubrizol Chemical Company, for instance LZ 539 C; dehazers, e.g., alkoxylated phenol formaldehyde polymers such as those commercially available as NALCO EC5462A (formerly 7D07) (ex Nalco), and TOLAD 2683 (ex Petrolite)(NALCO and TOLAD are trademarks); anti-foaming agents (e.g., the polyether-modified polysiloxanes commercially available as TEGOPREN 5851 and Q 25907 (ex Dow Corning), SAG TP-325 (ex OSi), or RHODORSIL (ex Rhone Poulenc)) (TEGOPREN, SAG and RFIODORSLL are trademarks); ignition improvers (cetane improvers) (e.g., 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g., that sold commercially by Rhein Chemie, Mannheim, Germany as "RC 4801", a propane-1, 2-diol semi-ester of tetrapropenyl succnic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g., the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); and metal deactivators.

The additive concentration of each such additional component in the additivated fuel composition is preferably up to 1% w/w, more preferably in the range from 5 to 1000 ppmw, advantageously from 75 to 300 ppmw, such as from 95 to 150 ppmw.

The invention will be illustrated by means of the following non-limiting example.

EXAMPLE 1

A 50/50 wt % blend of a Shell MDS Waxy Raffinate and a vacuum gas oil fraction as obtained in the same Shell MDS process was used as feed to a catalytic dewaxing reactor. The Shell MDS Waxy raffinate is the high boiling fraction as obtained when hydrocracking the Fischer-Tropsch product. A description of this Waxy Raffinate product and its preparation is described in "The Markets for Shell Middle Distillate Synthesis Products", Presentation of Peter J. A. Tijm, Shell International Gas Ltd., Alternative Energy '95, Vancouver, Canada, May 2-4, 1995. The blended feed had the properties as listed in Table 1.

TABLE 1

| Feed to catalytic dewaxing reactor | |
|---|---|
| Density at 70° C. (kg/m$^3$) | 772.9 |
| Pour point (° C.) | +30 |
| Kinematic viscosity at 40° C. (cSt) | 13.13 |
| Kinematic viscosity at 100° C. (cSt) | 3.207 |
| Initial boiling point (° C.) | 225 |
| T50 wt % boiling point (° C.) | 401 |
| Final boiling point (° C.) | 578 |

In the dewaxing reactor the feed of Table 1 was contacted with a dealuminated silica bound ZSM-5 catalyst comprising 0.7% by weight Pt and 30 wt % ZSM-5 as described in Example 9 of WO-A-0029511. The dewaxing conditions were 40 bar hydrogen, WHSV=1 kg/l.h, a gas rate of 700 Nl/kg and a temperature of 340° C.

From the dewaxed effluent a dewaxed gas oil fraction having the properties as listed in Table 2 was isolated by means of distillation at a pressure of 3 mmHg at the top of the column. For comparison the properties of a Fischer-Tropsch derived gas as obtained from the commercial Shell Middle Distillate Synthesis Process is also listed in Table 2.

TABLE 2

| | Catalytically dewaxed gas oil | Non-dewaxed commercial FT derived gas oil |
|---|---|---|
| 5 wt % recovery boiling point (T 5 wt % in ° C.) | 220 | 225 |
| 95 wt % recovery boiling point (T 95 wt % in ° C.) | 370 | 350 |
| Lubricity as measured in a High Frequency Reciprocating Rig (HFRR test) according to CEC-F-06-A-96) (micron) | 378/361 | 604/605 |
| Cloud point (ISO 3015) (° C.) | −57 | 2 |
| CFFP (EN 116) (° C.) | −41 | 0 |

We claim:

1. A process to prepare a catalytically dewaxed gas oil or gas oil blending component by (a) hydrocracking/hydroisomerizing a Fischer-Tropsch product;

(b) separating the product of step (a) into at least one or more fuel fractions and a gas oil precursor fraction, which gas oil precursor fraction has a T10 wt % boiling point of between 200° C. and 450° C. and a T90 wt % boiling point of between 400° C. and 550° C.;

(c) catalytically dewaxing the gas oil precursor fraction obtained in step (b);

(d) isolating the catalytically dewaxed gas oil or gas oil blending component from the product of step (c) by means of distillation;

(e) recycling a heavy fraction remaining from step (d) to step (a); and (f) feeding a fraction of the Fischer-Tropsch product comprising $C_{12}$-$C_{24}$ primary alcohols to step (b) in such an amount that the resulting gas oil or gas oil blending component has an oxygen content of between 0.001 wt % and 3 wt % on a water-free basis.

2. The process of claim 1, wherein the conversion in step (a) is between 25 wt % and 80 wt %.

3. The process of claim 1, wherein the gas oil precursor fraction has a kinematic viscosity at 100° C. of between 3 cSt and 10 cSt.

4. The process of claim 1, wherein the isolated gas oil or gas oil blending component has a cloud point of below −40° C. and a cold filter plugging point of below 30° C.

5. A gas oil blend comprising a catalytically dewaxed gas oil blend as obtained in the process to prepare a catalytically dewaxed gas oil or gas oil blending component by (a) hydrocracking/hydroisomerizing a Fischer-Tropsch product;

(b) separating the product of step (a) into at least one or more fuel fractions and a gas oil precursor fraction, which gas oil precursor fraction has a T10 wt % boiling point of between 200° C. and 450° C. and a T90 wt % boiling point of between 400° C. and 550° C.;

(c) catalytically dewaxing the gas oil precursor fraction obtained in step (b);

(d) isolating the catalytically dewaxed gas oil or gas oil blending component from the product of step (c) by means of distillation;

(e) recycling a heavy fraction remaining from step (d) to step (a); and (f) feeding a fraction of the Fischer-Tropsch product comprising $C_{12}$-$C_{24}$ primary alcohols to step (b) in such an amount that the gas oil blend has an oxygen content of between 0.001 wt % and 3 wt % on a water-free basis; and, one or more additives.

6. The gas oil blend of claim 5, further comprising a petroleum crude derived gas oil fraction and/or a gas condensate gas oil and wherein the content of Fischer-Tropsch derived gas oil fractions in said blend is between 10 wt % and 40 wt %.

7. The gas oil blend of claim 6, wherein the blend has a density of less than 0.86 g/cm$^3$ and a sulfur content of less than 500 ppm.

* * * * *